US006277054B1

(12) United States Patent
Kuo

(10) Patent No.: US 6,277,054 B1
(45) Date of Patent: Aug. 21, 2001

(54) EXERCISER HAVING ADJUSTABLE MECHANISM

(76) Inventor: Hai Pin Kuo, No. 158, Sec. 1, Er Jen Road, Jen Teh Hsiang, Tainan Hsien (TW)

( * ) Notice: Subject to any disclaimer, the term of this patent is extended or adjusted under 35 U.S.C. 154(b) by 0 days.

(21) Appl. No.: 09/617,772

(22) Filed: Jul. 17, 2000

(51) Int. Cl.[7] ..... A63B 69/16; A63B 22/04
(52) U.S. Cl. ..... 482/51; 482/57; 482/70
(58) Field of Search ..... 482/51, 52, 53, 482/57, 70, 79, 80

(56) References Cited

U.S. PATENT DOCUMENTS 5,383,829 1/1995 Miller ..... 482/57
5,759,136 * 6/1998 Chen ..... 482/57
5,762,588 * 6/1998 Chen ..... 482/57
5,779,599 7/1998 Chen ..... 482/57
6,077,198 * 6/2000 Eschenbach ..... 482/52

* cited by examiner

*Primary Examiner*—Stephen R. Crow
(74) *Attorney, Agent, or Firm*—Charles E. Baxley, Esq

(57) ABSTRACT

An exerciser includes a base having a front post and having a pair of cranks rotatably secured to the rear portion. A pair of bars are pivotally secured to the posts and each has a bottom pulley for supporting a track which is coupled to the cranks. A pair of levers have one end coupled to the bars and the other end slidably engaged on the tracks for supporting foot supports. A pair of slides are slidably received in the bars and coupled to the cranks. The bars each includes a rotatable bolt threaded with the slides for moving the slides along the bars when the bolts are rotated.

9 Claims, 5 Drawing Sheets

EXERCISER HAVING ADJUSTABLE MECHANISM

BACKGROUND OF THE INVENTION

1. Field of the Invention

The present invention relates to an exerciser, and more particularly to a stepping exerciser having an adjustable mechanism for adjusting the moving stroke or the moving path of the exerciser.

2. Description of the Prior Art

U.S. Pat. No. 5,383,829 to Miller discloses a typical exerciser having a pair of foot supports movable along an elliptical moving path which may not be adjusted. U.S. Pat. No. 5,779,599 to Chen discloses another typical exerciser having a pair of foot supports movable along an elliptical moving path. The elliptical moving path of the exerciser may be adjusted by threading and unthreading the fasteners which may not be quickly operated or may not be quickly threaded and unthreaded relative to the elements that are required to be adjusted.

The present invention has arisen to mitigate and/or obviate the afore-described disadvantages of the conventional exercisers.

SUMMARY OF THE INVENTION

The primary objective of the present invention is to provide an exerciser including an adjustable mechanism for easily and quickly adjusting the moving stroke or the moving path of the exerciser.

In accordance with one aspect of the invention, there is provided an exerciser comprising a base including a front portion having a post extended therefrom, and including a rear portion, the post including an upper portion, a pair of cranks rotatably secured to the rear portion of the base at a pivot shaft, the cranks each including a free end, a pair of bars pivotally secured to the upper portion of the post, the bars each including a middle portion and each including a bottom end having a first pulley provided thereon, a pair of tracks engaged and movably supported on the first pulleys, the tracks each including a first end rotatably secured to the free ends of the cranks respectively, a pair of levers each including a first end pivotally secured to the bars respectively at a pivot pin, and each including a second end slidably engaged on the tracks respectively, and each including a foot support provided thereon, a pair of slides slidably received in the bars respectively, a pair of links each including a first end rotatably secured to the free ends of the cranks respectively and each including a second end rotatably secured to the slides respectively, and adjusting means for adjusting the slides relative to the bars respectively. The adjusting means may provide one or more motor devices coupled to the slides for moving the slides along the respective bars and for adjusting the moving path of the foot supports.

The second ends of the levers each includes a second pulley provided thereon and engaged on the tracks respectively. The bars each includes a chamber formed therein for slidably receiving the slides respectively, the adjusting means includes a pair of bolts rotatably received in the bars respectively and threadedly coupled to the slides respectively, and rotating means for rotating the bolts to move and to adjust the slides along the bars respectively and thus to move and to adjust the second ends of the links along the bars respectively.

The slides each includes a tube coupled thereto and threadedly engaged with the bolts respectively. The rotating means includes a pair of motors secured to the bars respectively, and coupling means for coupling the motors to the bolts respectively to rotate the bolts. The coupling means includes a pinion attached to each of the motors, a gear attached to each of the bolts, and a reduction gearing mechanism coupled between the pinion and the gear for coupling the motors to the bolts respectively.

The bars each includes a sleeve slidably engaged thereon and secured to the slides and the second ends of the links respectively. The slides each includes a pole extended therefrom and engaged through the sleeve and the second end of the link. The bars each includes a slot formed therein for slidably receiving the poles of the slides respectively and for guiding the slides to move along the respective bars.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
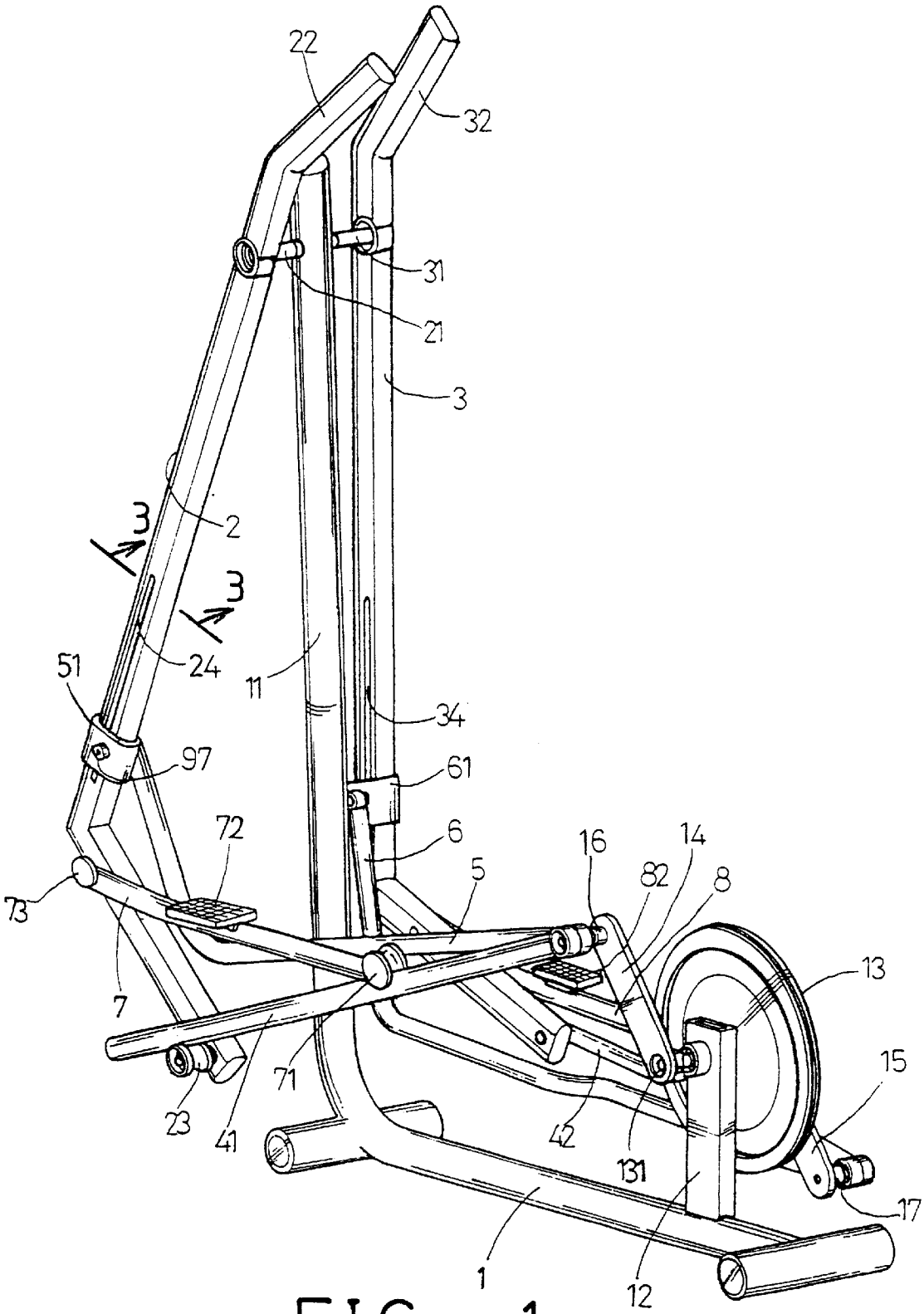
FIG. 1 is a perspective view of an exerciser in accordance with the present invention.
Figure 2:
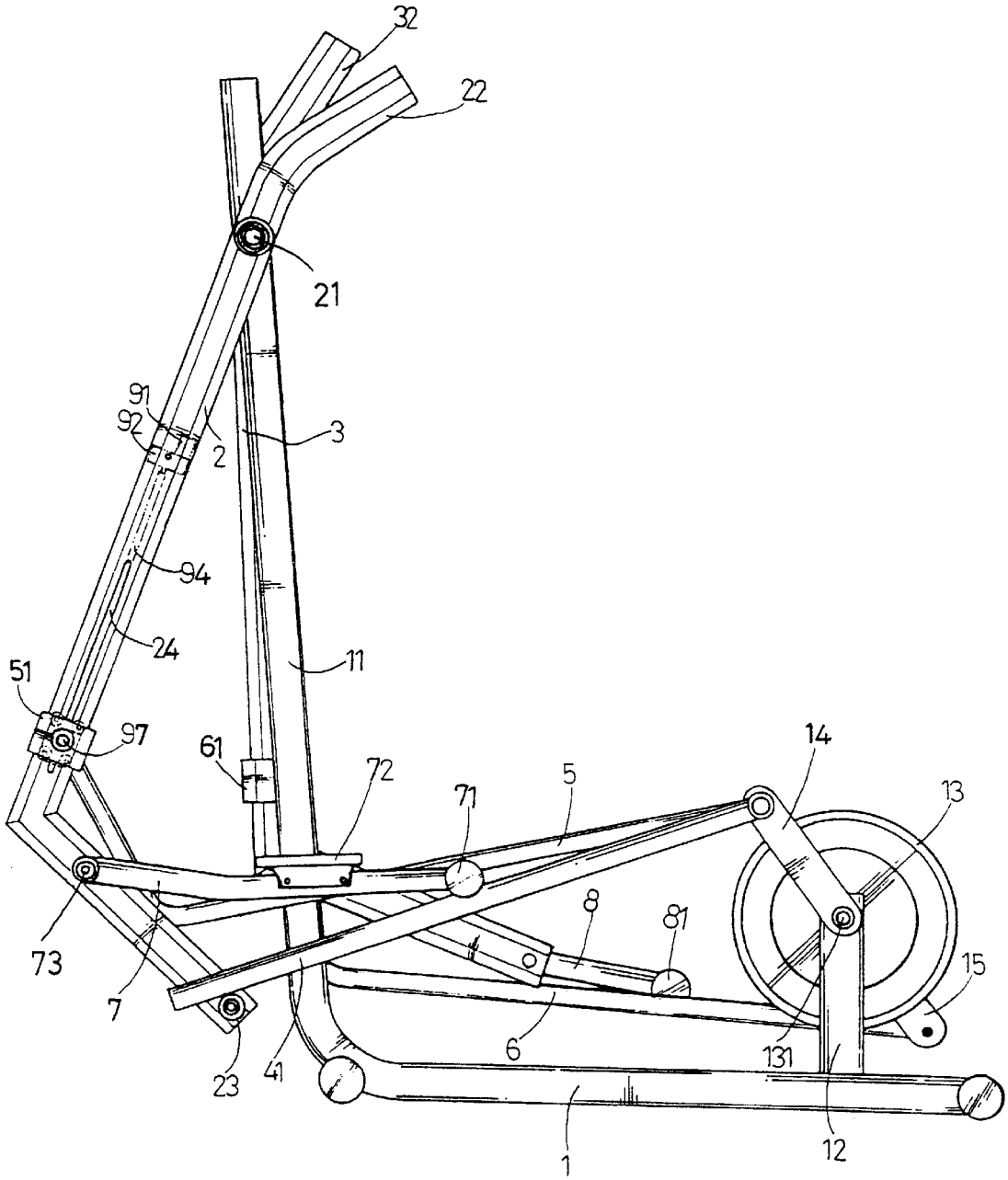
FIG. 2 is a side view of the exerciser.

Referring to the drawings, and initially to FIGS. 1 and 2, an exerciser, such as a stepping exerciser, in accordance with the present invention comprises a base 1 including a post 11 extended upward from or provided on the front portion thereof and including a stay 12 extended upward from or provided on the rear portion thereof. A wheel 13 and a pair of cranks 14, 15 are rotatably secured or supported on the stay 12 with a pivot shaft 131 and rotatable about the pivot shaft 131. The cranks 14, 15 are extended away from each other as that for the typical cycling devices, and each includes a free end having an axle 16, 17 attached thereto or provided thereon. The wheel 13 is used for providing a resistive force against the operation of the exerciser.

A pair of bars 2, 3 have a middle or upper portion rotatably or pivotally secured to the upper portion of the post 11 with one or more rods 21, 31, and each includes a handle 22, 32 provided on top thereof, and each includes a chamber 20 (FIG. 3) formed in the inner portion thereof, and each includes one or more slots 24, 34 formed in the middle or lower portion thereof and located or provided below the rods 21, 31, and each includes a bottom end having a pulley 23 attached thereto or provided thereon. A pair of tracks 41, 42 have a middle portion slidably or movably supported on the respective pulleys 23, and each includes one end pivotally or rotatably secured to the free ends of the cranks 14, 15 at the axles 16, 17 respectively. A pair of levers 7, 8 each has a front end pivotally or rotatably secured to the lower portions of the bars 2, 3 with a pivot pin 73, and each has a pulley 71, 81 attached to or provided on the rear portion thereof and rotatably or slidably or movably engaged on the respective tracks 41, 42, and each has a foot support 72, 82 provided on the middle portion thereof.

Figure 3:
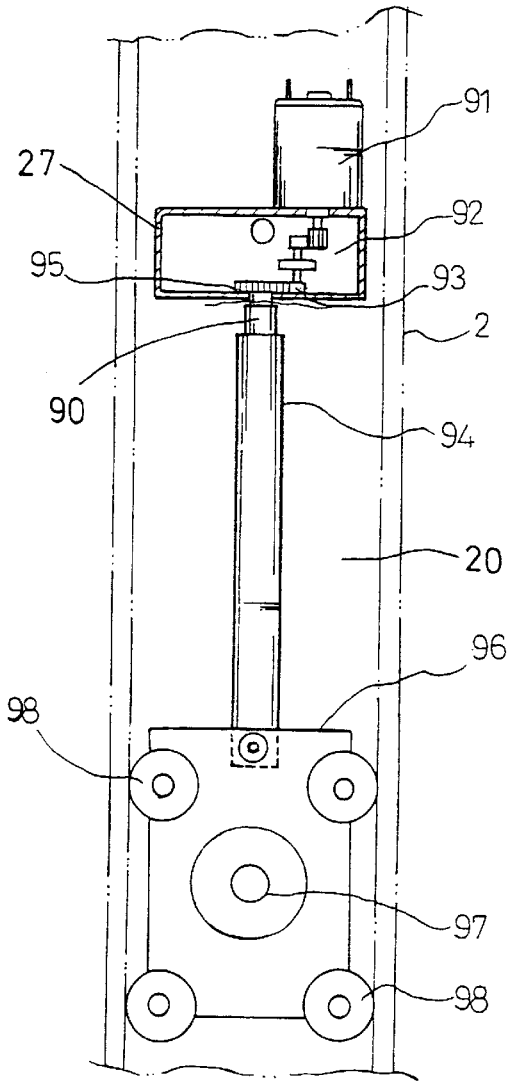
FIG. 3 is a partial cross sectional view taken along lines 3—3 of FIG. 1.
Figure 4:
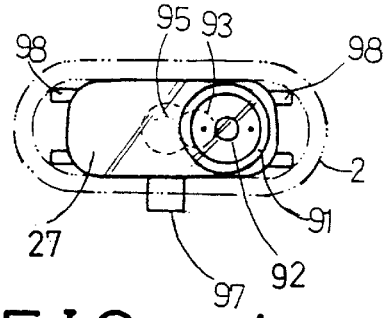
FIG. 4 is an end view of the elements as shown in FIG. 3.

As shown in FIGS. 2–4, the bars 2, 3 each includes a casing 27 secured therein. A bolt 90 is rotatably secured to each of the casings 27 and includes a gear 95 rotatably received in the casing 27. A motor 91 is secured in each of the bars 2, 3 and/or secured to the respective casings 27 and includes a pinion 92 extended therefrom or secured to the spindle thereof and preferably engaged in the casing 27. A reduction gearing device 93 is provided in the casing 27 and couples the pinion 92 of the motor 90 to the gear 95 of the bolt 90, thus the bolt 90 may be rotated by the motor 91 via the pinion 92 and the reduction gearing device 93 and the gear 95. A slide 96 is slidably received in each of the bars 2, 3 with rollers 98. A tube 94 is threaded with the bolt 90 and has one end pivotally secured to the slide 96, such that the slide 96 may be moved or adjusted along the respective bars 2, 3 by the motor 91 via the threading engagement between the bolt 90 and the tube 94. The slide 96 includes a pole 97 extended outward therefrom and slidably received in the respective slots 24, 34 of the bars 2, 3.

A pair of sleeves 51, 61 are slidably engaged on the respective bars 2, 3 and secured to the respective slides 96 with the poles 97 respectively, such that the sleeves 51, 61 move in concert with the respective slides 96 and such that the sleeves 51, 61 may be moved or adjusted along the respective bars 2, 3 by the motors 91. A pair of links 5, 6 each includes one end pivotally or rotatably secured to the free ends of the cranks 14, 15 at the axles 16, 17 respectively, and each includes the other end pivotally or rotatably secured to the respective sleeves 51, 61 with the pivot poles 97 or with the other pivots, such that the other ends of the links 5, 6 may be moved or adjusted along the respective bars 2, 3 together with the respective sleeves 51, 61, by the motors 91.

Figure 5:
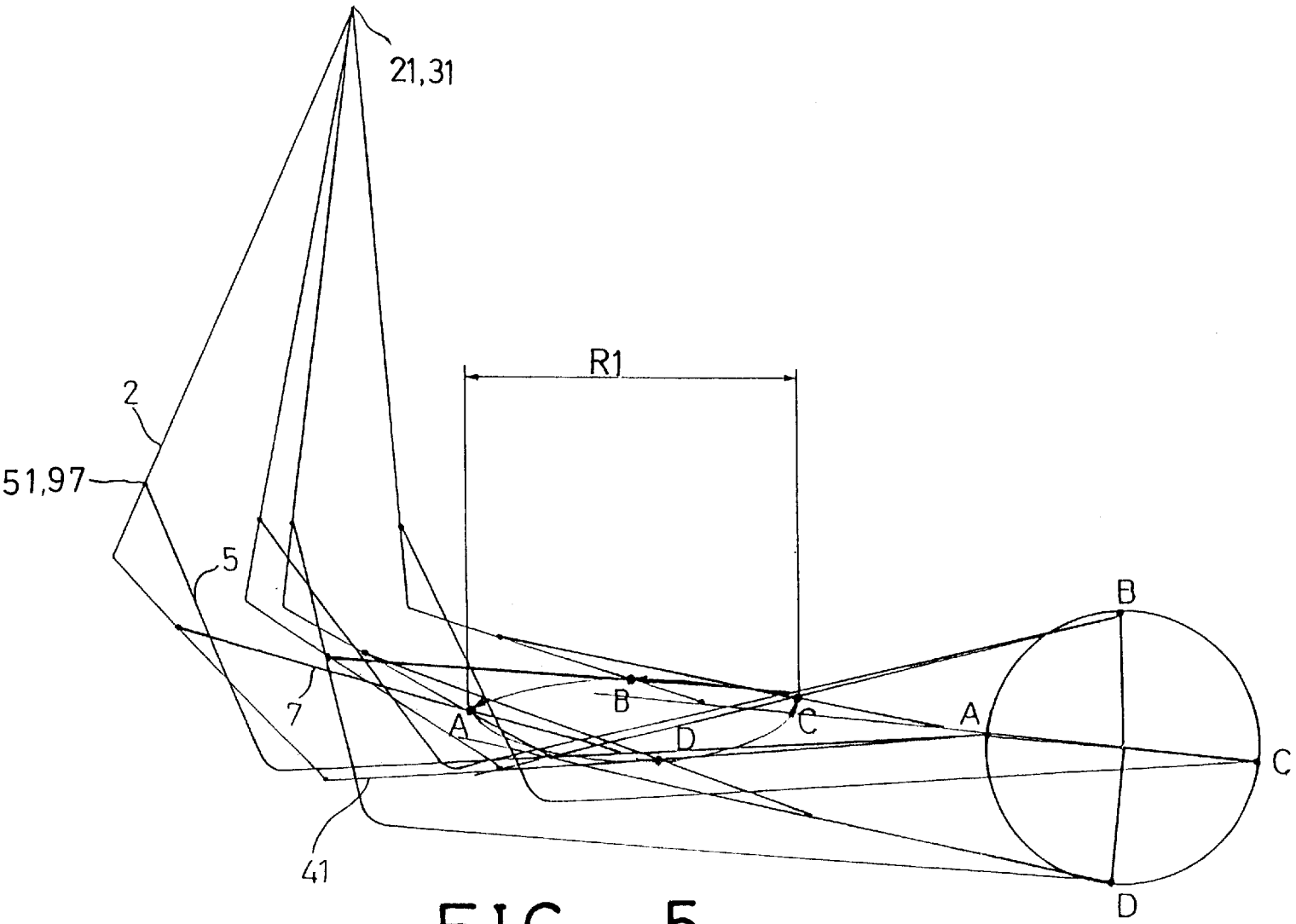
FIGS. 5 and 6 are schematic views illustrating the operation of the exerciser.
Figure 6:
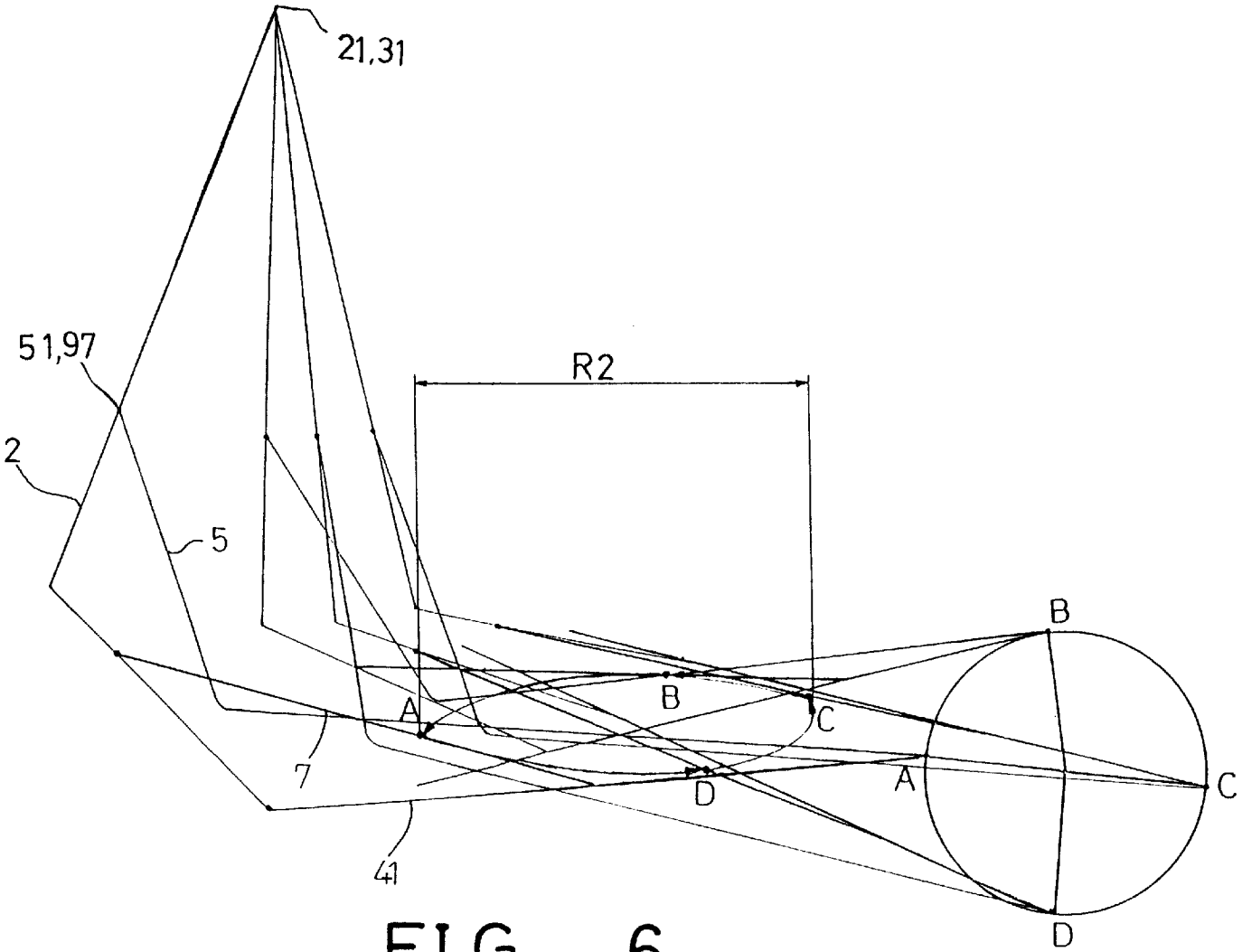

In operation, as shown in FIGS. 1, 2, 5, and 6, the foot supports 72, 82 may be moved along an elliptical moving path when the bars 2, 3 are moved or rotated about the rods 21, 31 and when the cranks 14, 15 are rotated about the pivot shaft 131. The other ends of the links 5, 6 may be moved or adjusted along the respective bars 2, 3 by the motors 91 via the pinions 92, the reduction gearing mechanisms 93, the gears 95, the bolts 90, the tubes 94, the slides 96 and the sleeves 51, 61, such that the elliptical moving paths of the foot supports 72, 82 may be adjusted. For example, as shown in FIGS. 5 and 6, the sleeves 51, 61 may be moved or adjusted away from (FIG. 5) or closer to (FIG. 6) the rods 21, 31, the longitudinal axis RI, R2 of the elliptical moving paths may thus be adjusted according to the user's requirements. The wheel 13 may provide a resistive force against the movement of the foot supports 72, 82.

Accordingly, the stepping exerciser in accordance with the present invention includes an adjustable mechanism for easily and quickly adjusting the moving stroke or the moving path of the exerciser.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a front portion having a post extended therefrom, and including a rear portion, said post including an upper portion, a pair of cranks rotatably secured to said rear portion of said base at a pivot shaft, said cranks each including a free end, a pair of bars pivotally secured to said upper portion of said post, said bars each including a middle portion and each including a bottom end having a first pulley provided thereon, a pair of tracks engaged and movably supported on said first pulleys, said tracks each including a first end rotatably secured to said free ends of said cranks respectively, a pair of levers each including a first end pivotally secured to said bars respectively at a pivot pin, and each including a second end slidably engaged on said tracks respectively, and each including a foot support provided thereon, a pair of slides slidably received in said bars respectively, a pair of links each including a first end rotatably secured to said free ends of said cranks respectively and each including a second end rotatably secured to said slides respectively, and adjusting means for adjusting said slides relative to said bars respectively to adjust a moving path of said foot supports.

2. The exerciser according to claim 1, wherein said second ends of said levers each includes a second pulley provided thereon and engaged on said tracks respectively.

3. The exerciser according to claim 1, wherein said bars each includes a chamber formed therein for slidably receiving said slides respectively, said adjusting means includes a pair of bolts rotatably received in said bars respectively and threadedly coupled to said slides respectively, and rotating means for rotating said bolts to move and to adjust said slided along said bars respectively.

4. The exerciser according to claim 3, wherein said slides each includes a tube coupled thereto and threadedly engaged with said bolts respectively.

5. The exerciser according to claim 3, wherein said rotating means includes a pair of motors secured to said bars respectively, and coupling means for coupling said motors to said bolts respectively to rotate said bolts.

6. The exerciser according to claim 5, wherein said coupling means includes a pinion attached to each of said motors, a gear attached to each of said bolts, and a reduction gearing mechanism coupled between said pinion and said gear for coupling said motors to said bolts respectively.

7. The exerciser according to claim 1, wherein said bars each includes a sleeve slidably engaged thereon and secured to said slides and said second ends of said links respectively.

8. The exerciser according to claim 7, wherein said slides each includes a pole extended therefrom and engaged through said sleeve and said second end of said link.

9. The exerciser according to claim 8, wherein said bars each includes a slot formed therein for slidably receiving said poles of said slides respectively.

* * * * *